US011781846B2

(12) United States Patent
Chicoine

(10) Patent No.: US 11,781,846 B2
(45) Date of Patent: Oct. 10, 2023

(54) CONFIGURABLE AMMUNITION PACKAGING APPARATUS

(71) Applicant: CK Manufacturing, LLC, Eagle, CO (US)

(72) Inventor: Gordon P. Chicoine, Gypsum, CO (US)

(73) Assignee: CK Manufacturing, LLC, Eagle, CO (US)

( * ) Notice: Subject to any disclaimer, the term of this patent is extended or adjusted under 35 U.S.C. 154(b) by 0 days.

(21) Appl. No.: 17/643,024

(22) Filed: Dec. 7, 2021

(65) Prior Publication Data

US 2022/0090897 A1 Mar. 24, 2022

Related U.S. Application Data

(62) Division of application No. 16/745,109, filed on Jan. 16, 2020, now Pat. No. 11,226,186.

(60) Provisional application No. 62/793,703, filed on Jan. 17, 2019.

(51) Int. Cl.

| | |
|---|---|
| ***F42B 39/26*** | (2006.01) |
| ***B65B 35/56*** | (2006.01) |
| ***B65B 19/34*** | (2006.01) |
| ***B65B 5/08*** | (2006.01) |
| ***B65B 35/26*** | (2006.01) |

(52) U.S. Cl.

CPC ..... *F42B 39/26* (2013.01); *B65B 5/08* (2013.01); *B65B 19/34* (2013.01); *B65B 35/26* (2013.01); *B65B 35/56* (2013.01)

(58) Field of Classification Search

None

See application file for complete search history.

(56) References Cited

U.S. PATENT DOCUMENTS

| | | | | |
|---|---|---|---|---|
| 2,400,695 | A | 5/1946 | Jackson | |
| 2,406,176 | A | 8/1946 | Vergobbi | |
| 3,123,959 | A * | 3/1964 | Carriere et al. | B65B 19/34 53/143 |
| 3,266,613 | A | 8/1966 | Grafius | |
| 4,567,712 | A * | 2/1986 | Varallo | B65B 61/207 53/250 |
| 5,054,363 | A * | 10/1991 | Scharch | B65B 57/06 86/47 |
| 5,201,398 | A * | 4/1993 | Clugston | B65G 47/14 99/360 |
| 6,510,938 | B1 * | 1/2003 | Bowlin | B65G 47/1407 198/450 |
| 8,820,206 | B2 * | 9/2014 | Coma Asensio | F42B 33/001 86/19.5 |
| 2014/0260925 | A1 * | 9/2014 | Beach | F42B 33/0207 86/28 |

* cited by examiner

*Primary Examiner* — Tanzim Imam

(74) *Attorney, Agent, or Firm* — Martensen IP; Michael C. Martensen

(57) ABSTRACT

An ammunition packaging apparatus and system is reconfigurable to package a select caliber of ammunition by changing a set of components to those associated with the selected caliber of ammunition and selecting the corresponding operating procedure. An ammunition collating and packaging apparatus can be quickly reconfigured from packaging a first caliber of ammunition to packaging a second caliber of ammunition by quickly replacing a define set of components and modifying operationally timings to correspond to the selected caliber.

6 Claims, 8 Drawing Sheets

CONFIGURABLE AMMUNITION PACKAGING APPARATUS

RELATED APPLICATION

The present application is a divisional of and claims the benefit of priority to U.S. patent application Ser. No. 16/745,109 filed 16 Jan. 2020 which relates to and claims the benefit of priority to U.S. Provisional Patent Application No. 62/793,703 filed 17 Jan. 2019 both of which are hereby incorporated by reference in their entirety for all purposes as if fully set forth herein.

BACKGROUND OF THE INVENTION

Field of the Invention

Embodiments of the present invention relate, in general, to ammunition sorting and packaging and more particularly to a configurable ammunition packaging apparatus.

Relevant Background

A number of solutions exist for automatically loading ammunition into packing trays. By "packing trays" is meant structures (polymer, plastic or other rigid structure capable of fixing an ammunition round in place) that hold ammunition in a fixed position. These packing trays are then further housed within ammunition containers of some kind and size (from simple cartons to corrugated cardboard cases to loaded pallets of cases) which contain any arbitrary number of packing trays. Various types and sizes of ammunition containers loaded with packing trays are then sold commercially. The packing trays hold the ammunition in fixed, oriented positions within the container, as opposed to allowing the live ammunition rounds ("rounds") to freely move about within the container. Large ammunition manufacturing companies—those producing ammunition in such large quantities that they can supply the very-large-volume requirements, often utilize robotic ammunition-loading machines that effect this automated process. The setup and implementation of each such machine typically requires months and each machine is capable of loading but a single caliber of ammunition.

Smaller ammunition manufacturers do not produce the volumes needed to justify the relatively exorbitant costs of such massive systems. Moreover, these smaller manufacturers typically produce many types of calibers, for both handguns as well as rifles, based on individualized, customer demand. Nonetheless, the need to package ammunition in a fixed position remains. Some attempts to overcome these problems have included use of so-called "shaker tables", which load handgun rounds into trays, but these are labor-intensive and work only for specific caliber types. Additionally, these types of solutions do not work for lighter-weight bullets, such as so-called "frangible" rounds nor will they work for rifle rounds as the center of gravity precludes of such rounds precludes consistent orientation. Existing solutions thus fail to meet the needs of the small manufacturer because none addresses these problems.

Accordingly, a need exists for an elegant solution that simplifies the ammunition-loading process for small manufacturers, to provide reasonably high-rate, automated tray-loading of ammunition and to do so while providing the flexibility to accommodate differing calibers and types of ammunition, whether for handguns or for rifles.

These and other deficiencies of the prior art are addressed and resolved by one or more embodiments of the present invention. Additional advantages and novel features of this invention shall be set forth in part in the description that follows, and in part will become apparent to those skilled in the art upon examination of the following specification or may be learned by the practice of the invention. The advantages of the invention may be realized and attained by means of the instrumentalities, combinations, compositions, and methods particularly pointed out in the appended claims.

SUMMARY OF THE INVENTION

A convertible apparatus for ammunition packaging can accept one of a plurality of caliber specific component sets thereby reconfiguring its ability to package ammunition of a select caliber. One embodiment of such an apparatus includes an ammunition collator coupled to an ammunition channel whereby one or more rounds of ammunition are delivered sequentially from the ammunition collator to a first opening of the ammunition channel. The ammunition is delivered to the channel in a horizontal orientation and alternatively laterally displaced along a vertical path. For the purpose of the present invention each round of ammunition is cylindrical in shape having a central longitudinal axis bounded by a first substantially circular end and a second substantially conical end. The horizontal orientation referred, as discussed herein, is defined as when the longitudinal axis is substantially perpendicular with a gravitational force and the vertical orientation is defined as when the longitudinal axis is substantially parallel with the gravitational force and the second conical end is beneath the first circular end.

The invention further includes a flipper tray having several furrows or grooves in a horizontal orientation. The flipper tray moves side-to-side (laterally) along a track beneath a second (bottom) opening of the ammunition channel. From that position the flipper tray accepts in each furrow a single round of ammunition.

At the end of the flipper tray track and proximate (close) to the flipper tray is one or more down chute assemblies. Each down chute assembly includes a plurality of down chutes positioned in a vertical orientation. The down chutes matching the plurality of furrows, each down chute is configured to accept the single round of ammunition residing in a corresponding furrow.

A rotating device is coupled to the flipper tray rotates the flipper tray approximately 90 degrees from a horizontal orientation to a vertical orientation once the furrows of the flipper tray are aligned with the down chutes of the down chute assembly. As the flipper tray rotates each round of ammunition residing in a furrow slides into the aligned down chute of the down chute assemble, now in the vertical orientation.

Lastly the invention uses ammunition trays having several holes or receptacles for receiving ammunition. The tray is moveable such that each ammunition receptacle (hole) is aligned with a down chute and configured to accept a single round of ammunition as it slides down the down chute. Once the row of receptacles is filled the tray moves forward filling the next row until the tray is full. The invention continually progresses the trays forward presenting a new row as the prior row is filled. Once a tray is full the invention moves empty trays to the filling position. The filled trays are moved to an exit and are replaced with awaiting empty trays.

The ammunition channel, the flipper tray, the down chute assembly and ammunition tray of the present invention are each replaceable as they are associated with a specific caliber of ammunition. Each of the ammunition channel, the flipper tray, the down chute assembly and ammunition tray is removably reconfigurable so to enable the apparatus adaptable to other calibers of ammunition.

In one embodiment of the present invention the ammunition channel, the flipper tray, the down chute assembly, and the ammunition tray define a first component set associated with a first ammunition caliber. A second component set includes a second ammunition channel, a second flipper tray, a second down chute assembly and a second ammunition tray is associated with a second ammunition caliber. The apparatus of the present invention is reconfigurable to the second ammunition caliber from the first ammunition caliber by replacing the first component set with the second component set. In other embodiments the present invention can be reconfigured for a different caliber of without changing the entirety of a component set. Indeed several different calibers may be packaged without changing the components but with only minor timing modifications or with no modifications at all.

One version of the present invention also includes a machine, capable of executing instructions embodied as software, communicatively coupled to a non-transitory computer readable storage media having a plurality of software portions. One of the software portions is configured to position each furrow of the flipper tray beneath the ammunition channel based on an ammunition caliber while another software portion is configured to position the ammunition tray to align each down chute with the plurality of ammunition receptacles in the tray based on the selected caliber of ammunition being packaged.

Another version of the present invention is a methodology for convertible ammunition packaging. Such a method includes configuring an ammunition collator with a collator plate based on a selected caliber of ammunition. By doing so the ammunition collator consistently orientates one or more rounds of ammunition so that it may be delivered to the ammunition channel.

The process continues by coupling the ammunition channel to the ammunition collator. The ammunition channel is sized for the selected caliber of ammunition caliber and as rounds of ammunition are delivered from the ammunition collator to the ammunition channel in a horizontal orientation they are alternatively laterally displaced along a vertical zig-zag path.

Positioning a flipper tray beneath a second opening (bottom) of the ammunition channel is the next step in the process. Recall the flipper tray includes a plurality of furrows where the size of each furrow is based on the selected caliber of ammunition. The flipper tray is positioned laterally (side-to-side) to accept a single round of ammunition in each furrow of the flipper tray in the horizontal orientation.

Positioning a down chute assembly proximate (close) to the flipper tray is the next step in the process. As previously described, each down chute assembly includes a number of down chutes sized according to the selected caliber of ammunition orientated vertically. The down chutes match the plurality of furrows in the flipper tray and each down chute is positioned and configured to accept a single round of ammunition from a corresponding furrow.

The process continues by rotating the flipper tray 90 degrees from the horizontal orientation to the vertical orientation when the furrows are aligned with the down chutes thereby placing each round of ammunition in the corresponding furrow in the aligned down chute.

Aligning each ammunition receptacle (hole) in an ammunition tray with a down chute so as to accept the single round of ammunition sliding down the down chute is the last step in the process. With a row of receptacles of the ammunition tray full, the tray advances, place new, unoccupied receptacles under the down chutes waiting for delivery of a round of ammunition.

The process described above can include reconfiguring the entirety of the system to the second caliber of ammunition from the first caliber of ammunition caliber by replacing the first component set with the second component set. The process also includes executing, by a machine, instructions embodied as software that position each furrow of the flipper tray beneath the ammunition channel based on ammunition caliber and position the ammunition tray to align each down chute with the receptacles in ammunition tray based on the caliber of ammunition being packaged.

Another version of the present invention is an ammunition packaging system. Such a system can include a first component set associated with a first ammunition caliber. Such a set includes a first collator plate, a first ammunition channel, a first flipper tray, a first down chute assembly and a first ammunition tray The system further includes a second component set associated with a second ammunition caliber. This set similarly includes a second collator plate, a second ammunition channel, a second flipper tray, a second down chute assembly, and a second ammunition tray.

An ammunition packaging apparatus makes up the last portion of the system. The apparatus is reconfigurable to package ammunition of the second ammunition caliber from the first ammunition caliber by selecting the second ammunition caliber and replacing the first component set with the second component set. Both the tray dimensions and number of rounds per tray are programmable and adjustable through modifications of the machine and software. A machine that can execute instructions embodied as software is communicatively coupled to the ammunition packaging apparatus. The software, when executed by the machine, positions the installed flipper tray beneath the installed ammunition channel, and aligns the plurality of ammunition receptacles of the installed ammunition tray with each down chute based on selecting caliber of ammunition.

Such a system can also include a user interface communicatively coupled to the machine configured to accept instructions to execute software portions associated with a particular component set.

The features and advantages described in this disclosure and in the following detailed description are not all-inclusive. Many additional features and advantages will be apparent to one of ordinary skill in the relevant art in view of the drawings, specification, and claims hereof. Moreover, it should be noted that the language used in the specification has been principally selected for readability and instructional purposes and may not have been selected to delineate or circumscribe the inventive subject matter; reference to the claims is necessary to determine such inventive subject matter.

BRIEF DESCRIPTION OF THE DRAWINGS

The aforementioned and other features and objects of the present invention and the manner of attaining them will become more apparent, and the invention itself will be best understood, by reference to the following description of one or more embodiments taken in conjunction with the accompanying drawings, wherein.

Figure 1A:
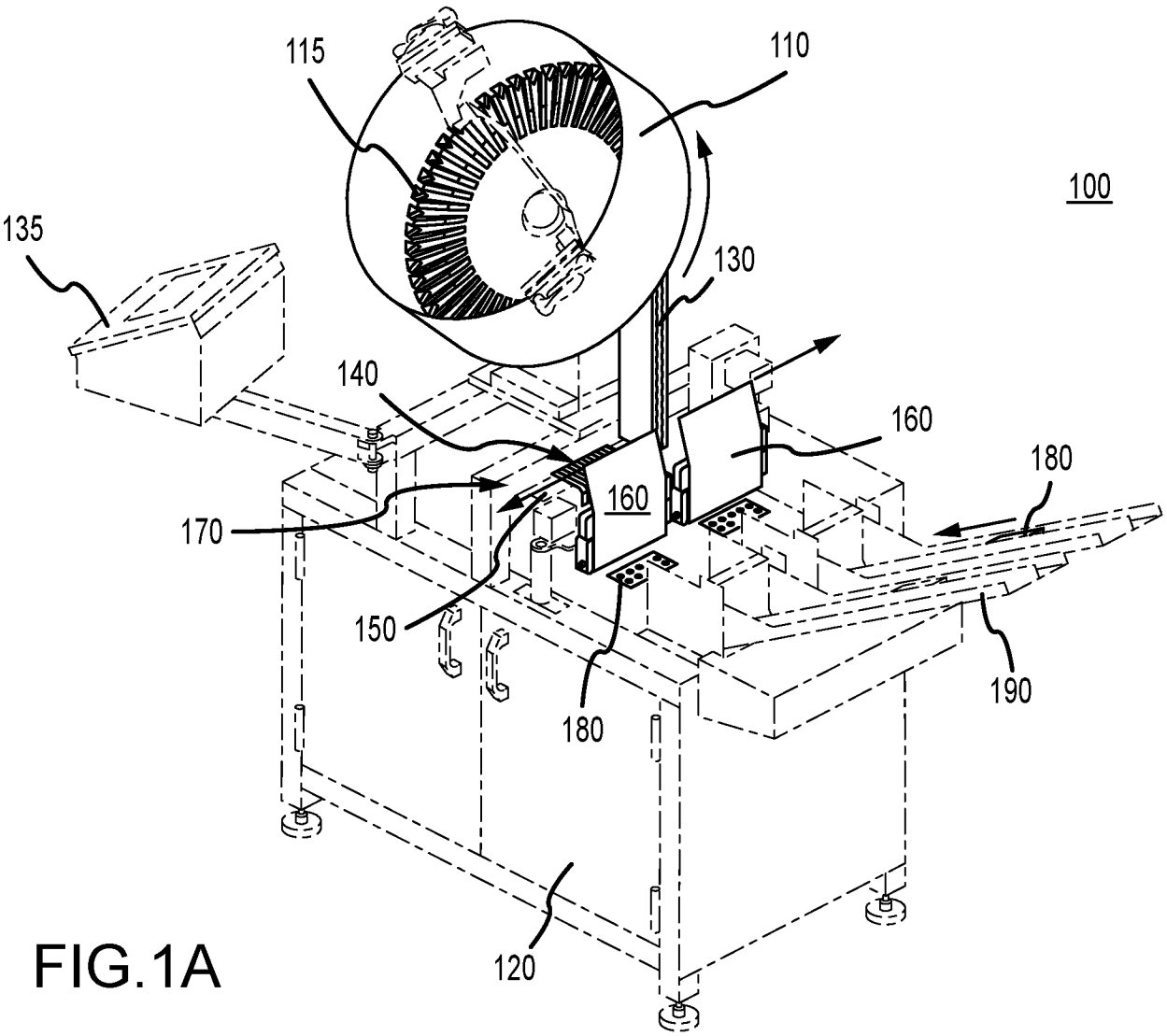
FIG. 1A is a front right perspective view of one embodiment of a configurable ammunition packaging apparatus.

The Figures depict embodiments of the present invention for purposes of illustration only. One skilled in the art will readily recognize from the following discussion that alternative embodiments of the structures and methods illustrated herein may be employed without departing from the principles of the invention described herein.

DESCRIPTION OF THE INVENTION

An Automatic Tray-Loading Machine (ATLM) repeatedly loads finished, live rounds of ammunition, of various calibers and types—both of handguns and of rifles—into advancing trays. The ATLM of the present invention collates, orients, feeds and positions ammunition rounds into trays, for final packaging into various types and sizes of ammunition containers. The ATLM is, moreover, reconfigurable so as to package a plurality of handgun or rifle calibers, requiring minimal time for reconfiguration.

Embodiments of the present invention are hereafter described in detail with reference to the accompanying Figures. Although the invention has been described and illustrated with a certain degree of particularity, it is understood that the present disclosure has been made only by way of example and that numerous changes in the combination and arrangement of parts can be resorted to by those skilled in the art without departing from the spirit and scope of the invention.

The following description with reference to the accompanying drawings is provided to assist in a comprehensive understanding of exemplary embodiments of the present invention as defined by the claims and their equivalents. It includes various specific details to assist in that understanding but these are to be regarded as merely exemplary. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

The terms and words used in the following description and claims are not limited to the bibliographical meanings, but, are merely used by the inventor to enable a clear and consistent understanding of the invention. Accordingly, it should be apparent to those skilled in the art that the following description of exemplary embodiments of the present invention are provided for illustration purpose only and not for the purpose of limiting the invention as defined by the appended claims and their equivalents.

By the term "substantially" it is meant that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

Like numbers refer to like elements throughout. In the figures, the sizes of certain lines, layers, components, elements or features may be exaggerated for clarity.

The terminology used herein is for the purpose of describing particular embodiments only and is not intended to be limiting of the invention. As used herein, the singular forms "a," "an" and "the" are intended to include the plural forms as well, unless the context clearly indicates otherwise. Thus, for example, reference to "a component surface" includes reference to one or more of such surfaces.

As used herein any reference to "one embodiment" or "an embodiment" means that a particular element, feature, structure, or characteristic described in connection with the embodiment is included in at least one embodiment. The appearances of the phrase "in one embodiment" in various places in the specification are not necessarily all referring to the same embodiment.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

It will be also understood that when an element is referred to as being "on," "attached" to, "connected" to, "coupled" with, "contacting", "mounted" etc., another element, it can be directly on, attached to, connected to, coupled with or contacting the other element or intervening elements may also be present. In contrast, when an element is referred to as being, for example, "directly on," "directly attached" to, "directly connected" to, "directly coupled" with or "directly contacting" another element, there are no intervening elements present. It will also be appreciated by those of skill in the art that references to a structure or feature that is disposed "adjacent" another feature may have portions that overlap or underlie the adjacent feature.

Spatially relative terms, such as "under," "below," "lower," "over," "upper" and the like, may be used herein for ease of description to describe one element or feature's relationship to another element(s) or feature(s) as illustrated in the figures. It will be understood that the spatially relative terms are intended to encompass different orientations of a device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of "over" and "under". The device may be otherwise oriented (rotated 90 degrees or at other orientations) and the spatially relative descriptors used herein interpreted accordingly. Similarly, the terms "upwardly," "downwardly," "vertical," "horizontal" and the like are used herein for the purpose of explanation only unless specifically indicated otherwise.

Figure 2:
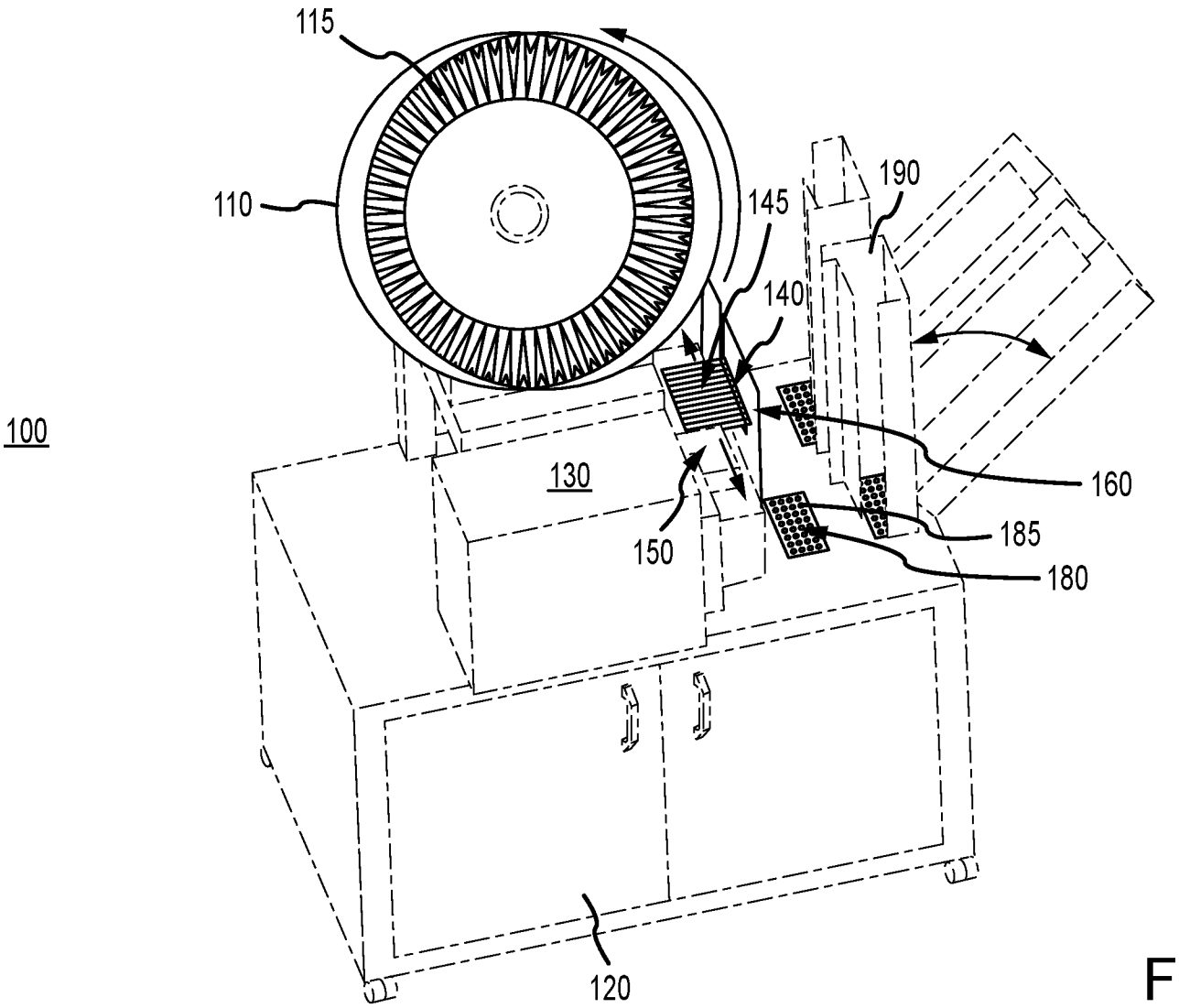
FIG. 2 is a front left perspective view of another embodiment of a configurable ammunition packaging apparatus of the present invention.

FIGS. 1A and 2 present perspective views of the configurable ammunition packaging apparatus 100 of the present invention. With reference to both figures, a cylindrical ammunition collator 110 is rotativity coupled to a cabinet 120. The cabinet includes a user interface 135 and a processor coupled to a non-transitory storage medium having one or more programs of instructions embodied as software. A motor, engaged with the collator 110 and communicatively coupled to the processor, is configured to rotate the ammunition collator 110 about a central axis. An ammunition collator plate 115 or laydown is positioned within the lower portion of the ammunition collator collates rounds of ammunition into a consistent orientation and delivers them via a void in the lower panel of the collator to a vertical ammunition channel 130.

The vertical ammunition channel 130 (also referred to herein as a zigzag channel) is removably affixed to the collator 110 and positioned in a vertical orientation beneath the outer circumferential ring of the ammunition collator 110. The vertical ammunition channel 130 includes a void or opening formed between two opposing sides wherein the first opening is aligned to sequentially accept one or more rounds of ammunition from the ammunition collator 110 in a horizontal orientation. For purposes of the present invention each round of ammunition is cylindrical in shape having a central longitudinal axis bounded by a first substantially circular end and a second substantially conical (bullet) end and wherein the horizontal orientation is defined as when the longitudinal axis is substantially perpendicular with a gravitational force and wherein the vertical orientation is defined as when the longitudinal axis is substantially parallel with the gravitational force and the second conical end is beneath the first circular end.

Figure 1B:
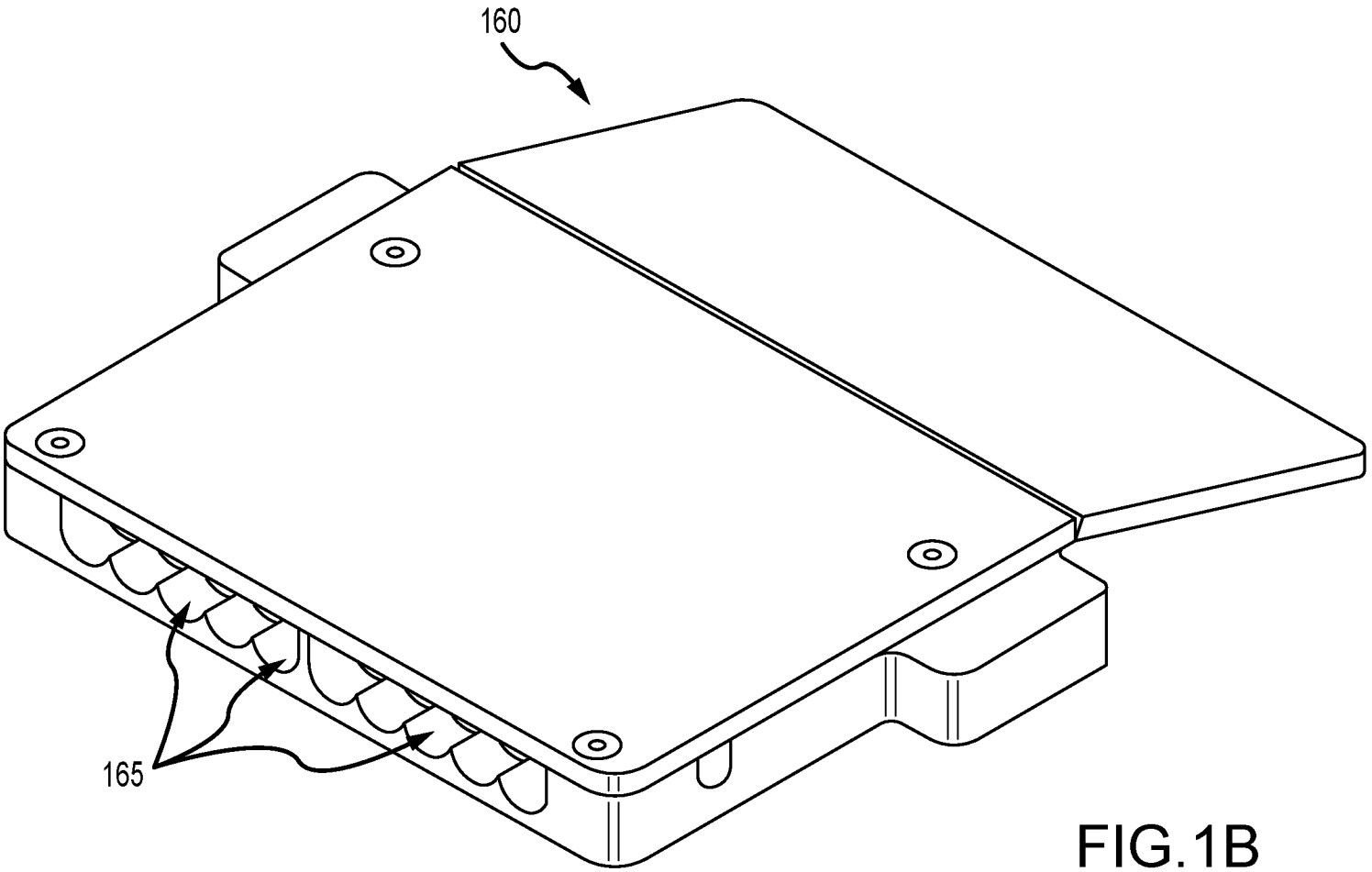
FIG. 1B is a perspective view of a down-chute assembly having a plurality of down chutes according to one embodiment of the present invention.
Figure 1C:
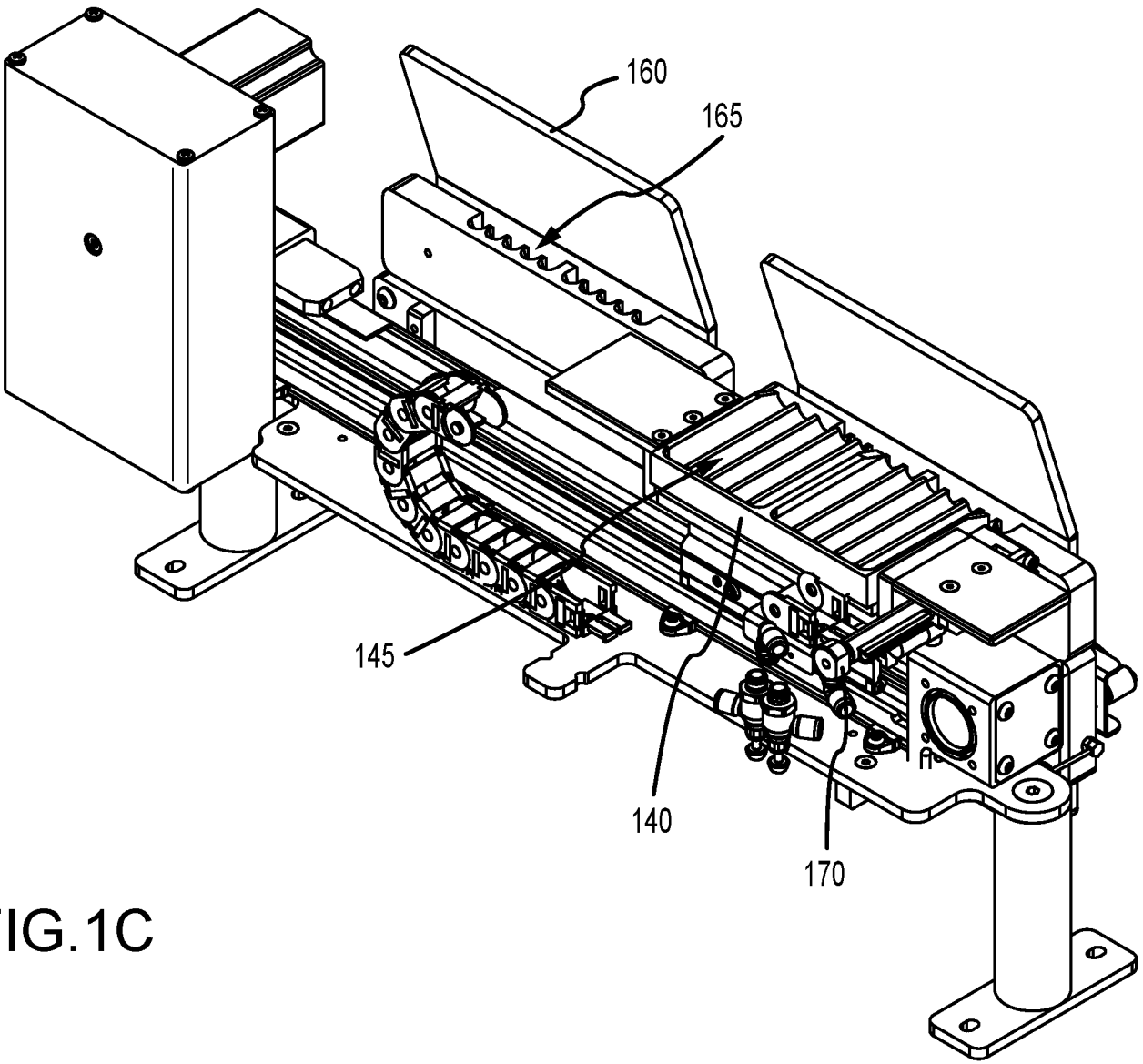
FIG. 1C is a perspective view of a flipper tray along a lateral track according to one embodiment of the present invention.

With additional reference to FIGS. 1B and 1C, rounds of ammunition are laterally displaced long the vertical path of the ammunition channel 130 as the ammunition descends vertically in a zigzag manner so to ultimately reside in the furrows 145 of a flipper tray 140. As one of reasonable skill in the relevant art can appreciate, the weight of successive rounds of ammunition stacked on top of each other would be cumulative. As the number of rounds in the vertical ammunition channel may vary, the cumulative weight and thus response of the last round in the stack during release would vary. Consequently, and according to one embodiment of the present invention the vertical ammunition channel is alternatively laterally displaced along the vertical channel. Such a displacement supports a portion of the weight of each round making the round positioned at the vertical ammunition channel's second opening subject to only to its weight and a small portion of the weight of the round immediately above it. The weight of the remaining rounds is supported by the latterly displaced edges of the channel.

The flipper tray 140 having a plurality of furrows 145 is movably positioned directly below the second opening of the ammunition channel 130. Each furrow is substantially semi-circular having a convex surface facing upward toward the second opening of the ammunition channel. Each furrow possesses a longitudinal and lateral axis with the longitudinal axis being substantially greater than the lateral axis. The longitudinal axis of each furrow in each flipper tray is aligned with the horizontal orientation of the ammunition as it resides in the ammunition channel.

In one embodiment each flipper tray includes a plurality of furrows. The number of furrows range from 4 to 10, although other tray with more or less furrows are contemplated. The flipper tray is movably positioned laterally, about the lateral axis of each furrow beneath the ammunition channel by a motor communicatively coupled to a processor, The processor executes code to position the trays so as to expose different, empty, furrows in the tray to the ammunition channel so as to receive a single round of ammunition.

As the flipper tray is laterally positioned along a track 150 beneath the second opening of the ammunition channel, each furrow of the tray is occupied by a round of ammunition. Upon recognition that each furrow 145 is occupied, the flipper tray is positioned at an end of the lateral track proximate to a down chute assemble 160. The down chute assemble 160 is positioned proximate to the track and removably affixed to the cabinet and includes a plurality of down chutes 165 in a vertical orientation wherein each of the plurality of down chutes match with and are aligned with one of the plurality of furrows in the flipper tray 140. Each down chute 165 is configured to accept the single round of ammunition residing in the corresponding furrow of the flipper tray. Software communicatively coupled to and directive of a plurality of motors position the flipper tray 140 to the end of the lateral track to align with each of the two down chutes 160, depending on the selected caliber.

A rotating device 170 affixed to the cabinet and communicatively coupled to the processor is additionally rotationally coupled to the flipper tray 140. The rotation device 170 is configured to rotate the flipper tray 140 90 degrees from the horizontal orientation as it would be when residing beneath the ammunition channel 130 to accept rounds of ammunition, to a vertical orientation consistent with the down chute assembly 160. Upon a sensor identifying that the plurality of furrows is aligned with the plurality of down chutes, the rotating device rotates the flipping tray thereby allowing each round of ammunition residing in the corresponding furrow to slide into the aligned down chute of the down chute assemble in a vertical orientation. In one embodiment, a standard air-actuated piston is used to tilt (rotate) the flipper tray to release rounds by gravity-feed.

A movable ammunition tray 180 configured to accept a plurality of rounds of ammunition is positioned below the down chute assemble on a movable track 190 or belt. A motor, communicatively coupled to the processor, is configured to drive the track or belt based on a select ammunition caliber. Each ammunition tray 180 includes a plurality of receptacles 185, wherein each receptacle is configured to accept a single round of ammunition in a vertical orientation. As the ammunition tray receives rounds of ammunition from the down chute assembly, the tray advances presenting to each down chute a new, unoccupied receptacle. One of reasonable skill in the relevant art will recognize that the moveable track for the ammunition tray 180 are shown with a different configuration in FIG. 1A and FIG. 2. Depending on the caliber for which the invention is configured and the style of ammunition trays 180 being used to accept the rounds, the invention can be adjusted to feed the trays so as to be aligned with the down chute assemblies 160.

In one embodiment of the present invention, a machine comprised of several interchangeable components, each of which performs a specific task, automatically loads rounds into trays. Rounds of a single type of caliber, whether handgun or rifle, are initially "dumped" (i.e., randomly dropped) into a "collator". Recall the ammunition collator 110 is a large, round cylinder whose top is open and whose bottom includes a removable collator plate having grooved channels near the cylinder's sides. These channels effectively collate the rounds, such that each round has a fixed orientation. As the collator 110 rotates about its central axis, successive rounds of ammunition are gravity-feed from the collator into the ammunition channel 130. The collator plate 115 orientates rounds into a certain direction, with each round "pointing" (i.e., bullet- or conical tip-first) radially outward and away from the cylinder's center and axis of rotation.

The ammunition channel 130 is a discharge conduit proximate to the bottom of the collator having a "zig-zag" cross-sectional pattern for precise round placement. The ammunition channel gravity-feeds one round at a time—albeit very rapidly—into the flipper tray. In one embodiment, the ammunition channel 130 is a single stack, but other embodiments could comprise any number of vertical stacks. In another embodiment the ammunition channel includes sensors communicatively coupled to a processor located in the cabinet. To ensure each furrow 145 of each flipper tray 140 is filled with a round of ammunition, a sensor located within the ammunition channel identifies that sufficient rounds exist in the channel so that, as the flipper tray laterally displaces under the ammunition channel, each furrow will be occupied by a single round of ammunition.

Should the sensor determine that not enough rounds are present, the lateral movement of the flipper tray 140 and release of the rounds of ammunition are stayed. Once enough rounds accumulate within the ammunition channel 130, movement of the flipper tray 140 along the track 150 and release of rounds continues. A second sensor located near the top of the ammunition channel identifies that additional rounds from the collator are not necessary. Accordingly, the processor disables a motor associated with the collator stopping delivery of rounds of the ammunition channel.

The flipper tray 140 lays horizontal, initially, and moves back and forth horizontally under the second opening of the ammunition channel 130. In one embodiment the ATLM has one flipping tray, and the tray has furrows, or channels, corresponding to a selected caliber. In other embodiments additional flipper trays are positioned beneath one or more ammunition channels to increase throughput. In one embodiment, the present invention uses 10 furrows for each flipper tray, but the number of channels is not restrictive, and any number of furrows can be used. Moreover, other embodiments could employ any number of flipper trays.

As previously described the flipper tray 140 traverses horizontally, in a back-&forth, left-and-right motion, passing under the second opening of the ammunition channel 130. In one embodiment, the flipper tray is recessed below surface within which it is housed, such that when the flipper tray completely clears the ammunition channel, no round can gravity-feed as there is no recessed round channel or furrow into which to fall and thus the round merely "rides" across the smooth surface of the flipper tray's housing surface until it again meets a recessed round furrow into which a round can gravity-feed. The non-recessed upper surfaces of the flipper tray are flush with the upper portion of the housing surface.

As the flipper tray 140 reaches its side-to-side travel limit, the flipper tray ceases its side-to-side translation and tips to cause the rounds positioned in the particular furrows to gravity feed into the down-chute assembly.

Each removable down chute 165 is a vertical path through which the rounds travel. A down-chute assembly 160 is positioned, in one embodiment, on either side of the flipper tray tack 150, such that when the flipper tray 140 rotates a chute is immediately below each furrow within which a round rests. For example, a flipper tray having 10 furrows will align itself with a down chute assembly 160 having 10 down chutes 165. As the tray 140 rotates, the rounds are delivered into a corresponding caliber specific down chute 165. Each round slide down its corresponding chute bullet-(or "nose" or "tip") first arriving into its complement, caliber-specific receptacle 185 in an ammunition tray 180. The tray then returns to a position under the ammunition channel to receive additional rounds in each furrow. As the tray reaches the other side of the track it once again rotates, delivering rounds to a second set of down chutes.

In one embodiment, the ATLM is controlled by a programmable logic controller (PLC) using industry-standard techniques to choreograph the entire automatic tray-loading process. As one of reasonable skill in the relevant art will appreciate other controllers, processors and machines capable of executing instructions embodied as software or combinations of software and firmware are equally compatible with the present invention. In one embodiment, each ammunition tray is positioned by a belt, track or similar device by the controller at precise intervals, according to spacing requirements dictated by caliber, to place a new row of empty slots for receiving rounds under the corresponding down chutes, once the previous row fills. The trays are thus machine-fed—that is, they "increment"—according to caliber size so that they synchronize with the collator and the flipper tray, which are also synchronized with each other through the PLC. The present invention is versatile in that the software portions can be modified to feed the ammunition trays based on differing configuration or styles. As one of reasonable skill can appreciate, not every ammunition tray manufactured is identical. The invention is adjustable to accommodate differing dimensions, spacing, etc.

A feature of the present invention is the ability to quickly reconfigure the ATLM for packaging ammunition rounds of different calibers. As discussed above the ammunition collator includes a collator plate (the grooved ring around the inner circumference of the collator that orients rounds before they exit the collator) that can be exchanged to collate rounds of a different caliber. Similarly, the ammunition channel, the flipper tray(s) down-chute assemblies and ammunition trays are all components that can be easily removed and replaced with a new set of components sized for a different caliber. All but the down-chute assemblies are, in one embodiment, fastened by standard screws, and the down-chute assemblies are fastened by four large hand-actuated lever-screws for ease of replacement. In most instances the entire machine can be reconfigured to package a different caliber of ammunition within 15 minutes.

Figure 3:
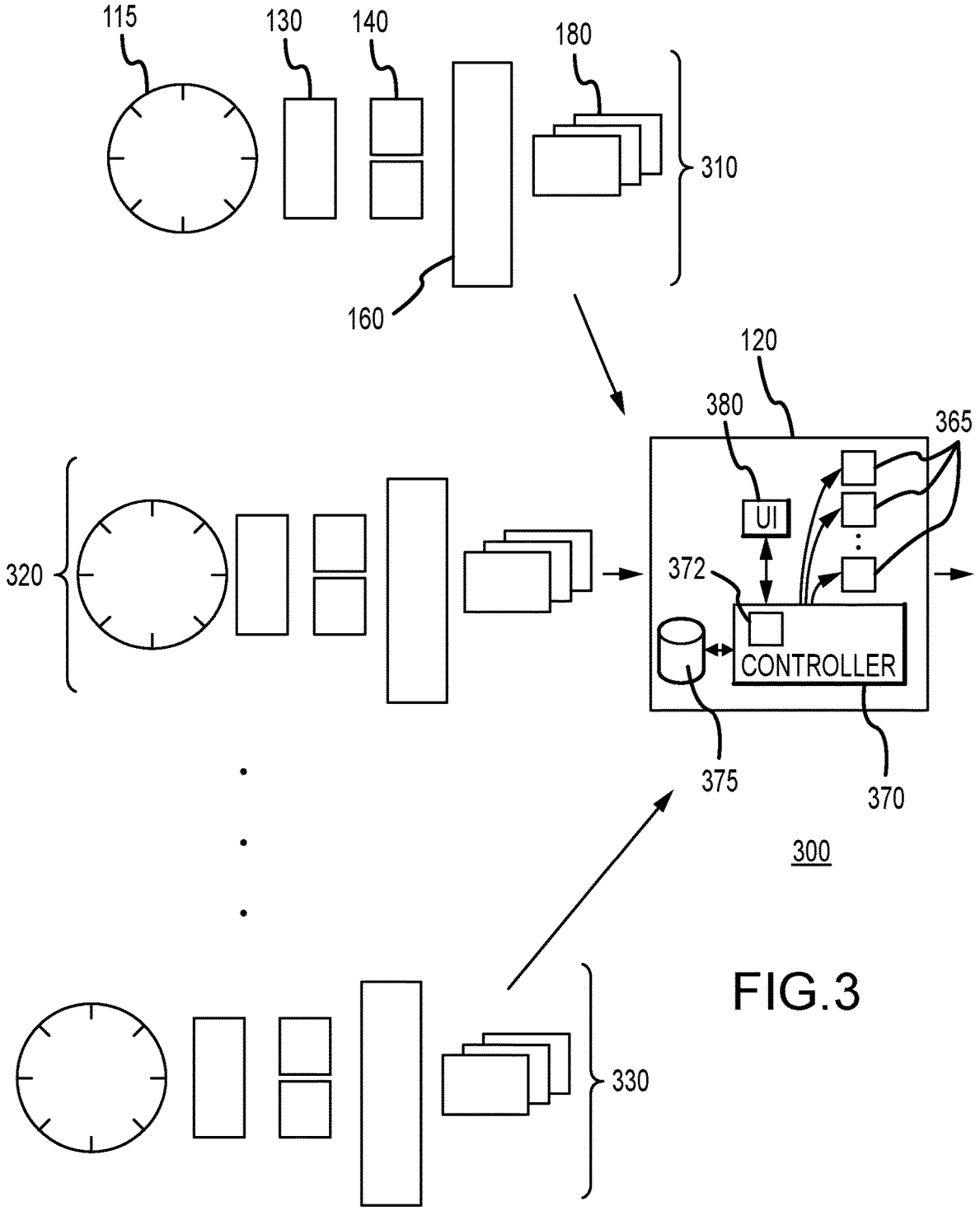
FIG. 3 is a high-level system diagram of a configurable ammunition packaging apparatus according to one embodiment of the present invention.

FIG. 3 is a graphical illustration of the reconfigurable nature of the ammunition packaging apparatus of the present invention. The ammunition packaging apparatus is a system 300 that combines a caliber specific set of components with common functional mechanism. Once combined a controller modifies the timing and response of motors and drives based on the selected caliber.

Each component set 310, 320, 330 shown in FIG. 3 includes a collator plate 115, an ammunition channel 130, a flipper tray 140, a down chute assembly 160 and ammunition trays 180. FIG. 3 shows three exemplary components sets 310, 320, 330 and the ammunition packaging apparatus cabinet 120 housing common function mechanisms. In other embodiments the component sets may have additional or fewer constituents need to modify the invention for a different caliber. Indeed in one embodiment of the present invention, the hardware components may remain the same for two or more different calibers, requiring only minor timing adjustments via a software portion. And some differing calibers of ammunition can be packaged using the same component set and software. For example 0.40 caliber and 10 mm rounds are, for the purpose of the present invention, packaged using the same set of components and software. In one embodiment common mechanisms includes a plurality of motors 365 and drives which are communicatively coupled to and controlled by a processor/controller 370. The processor 372, or similar machine, is communicatively coupled to the motors as well a non-transitory storage medium 375. The storage medium 375 includes instructions embodied as software that, when executed by the processor, instruct the various motors and drives to position the components based a specific caliber. A user interface 380, also communicatively coupled to the processor, provides user input as the which caliber specific set of components have been installed in the apparatus and which software portion(s) should be executed. In another embodiment of the present invention, sensors are mounted on the apparatus to identify which set of components are installed. Upon sensing a component set for a particular caliber of ammunition, the controller retrieves from the storage media the proper software potion which is thereafter executed by the processor.

Figure 4:
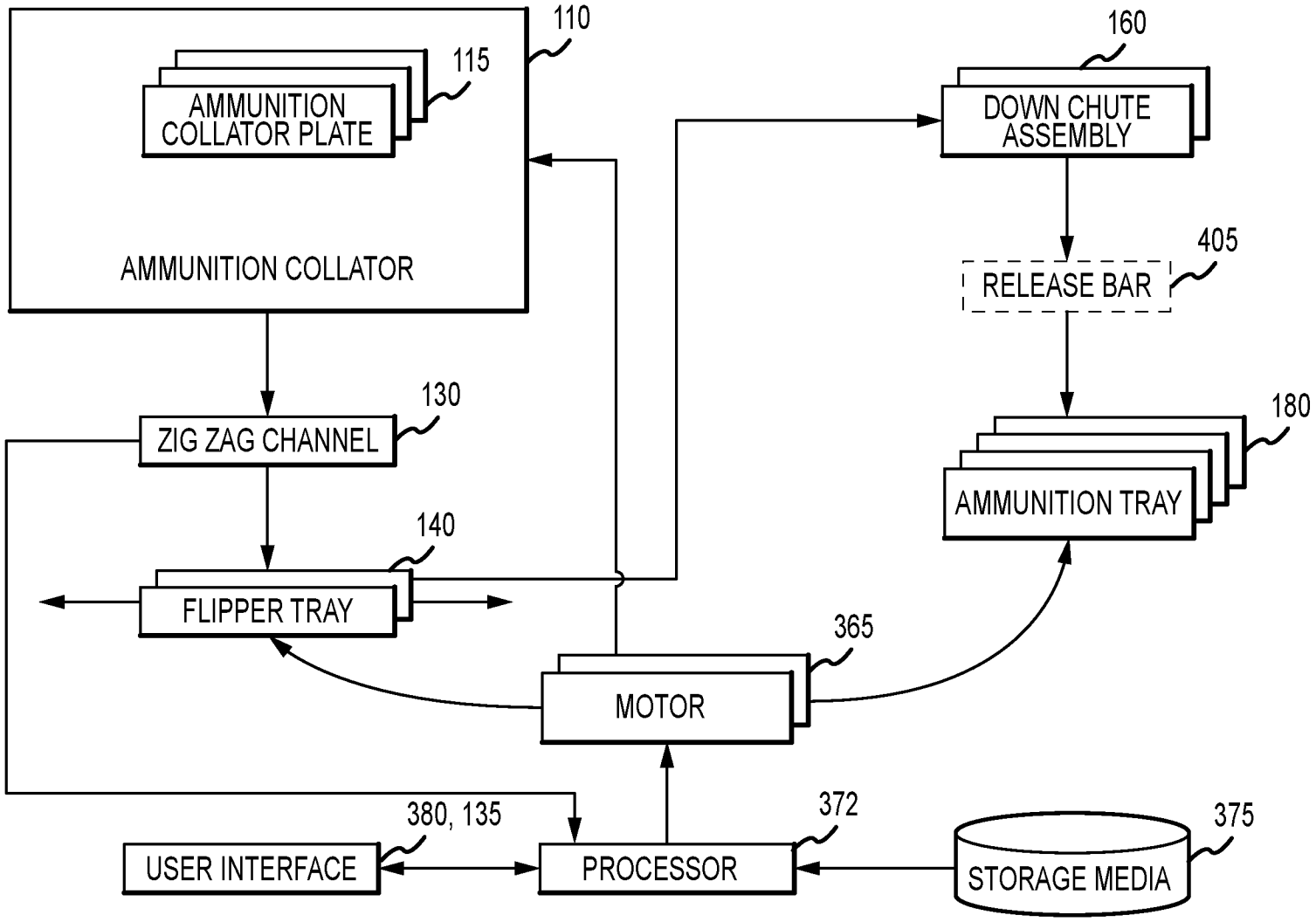
FIG. 4 is a process flow diagram of a configurable ammunition packaging apparatus according to one embodiment of the present invention.
Figure 5A:
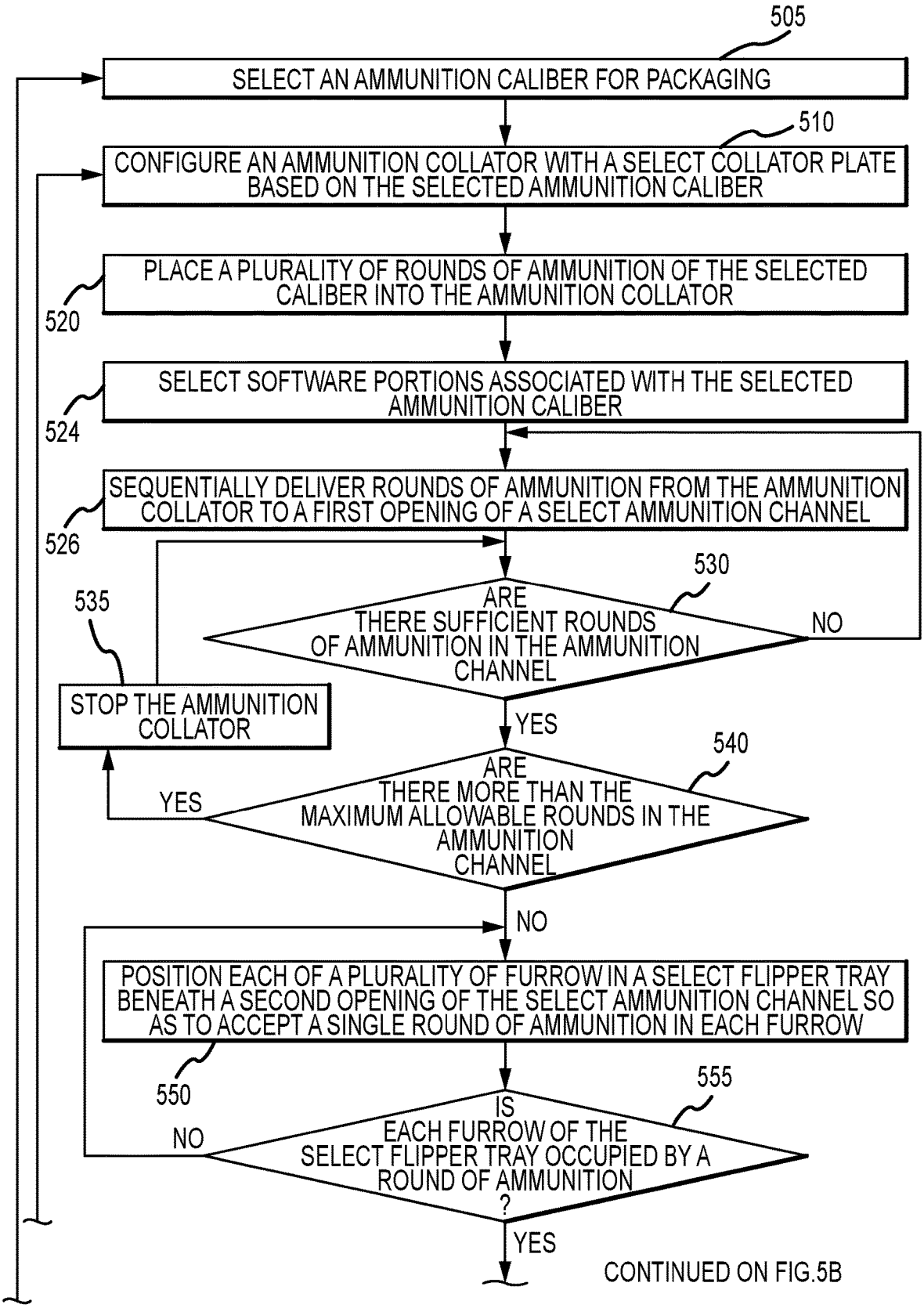
FIGS. 5A and 5B (collectively FIG. 5) present a flowchart for one methodology configuring an ammunition packaging apparatus, according to the present invention.
Figure 5B:
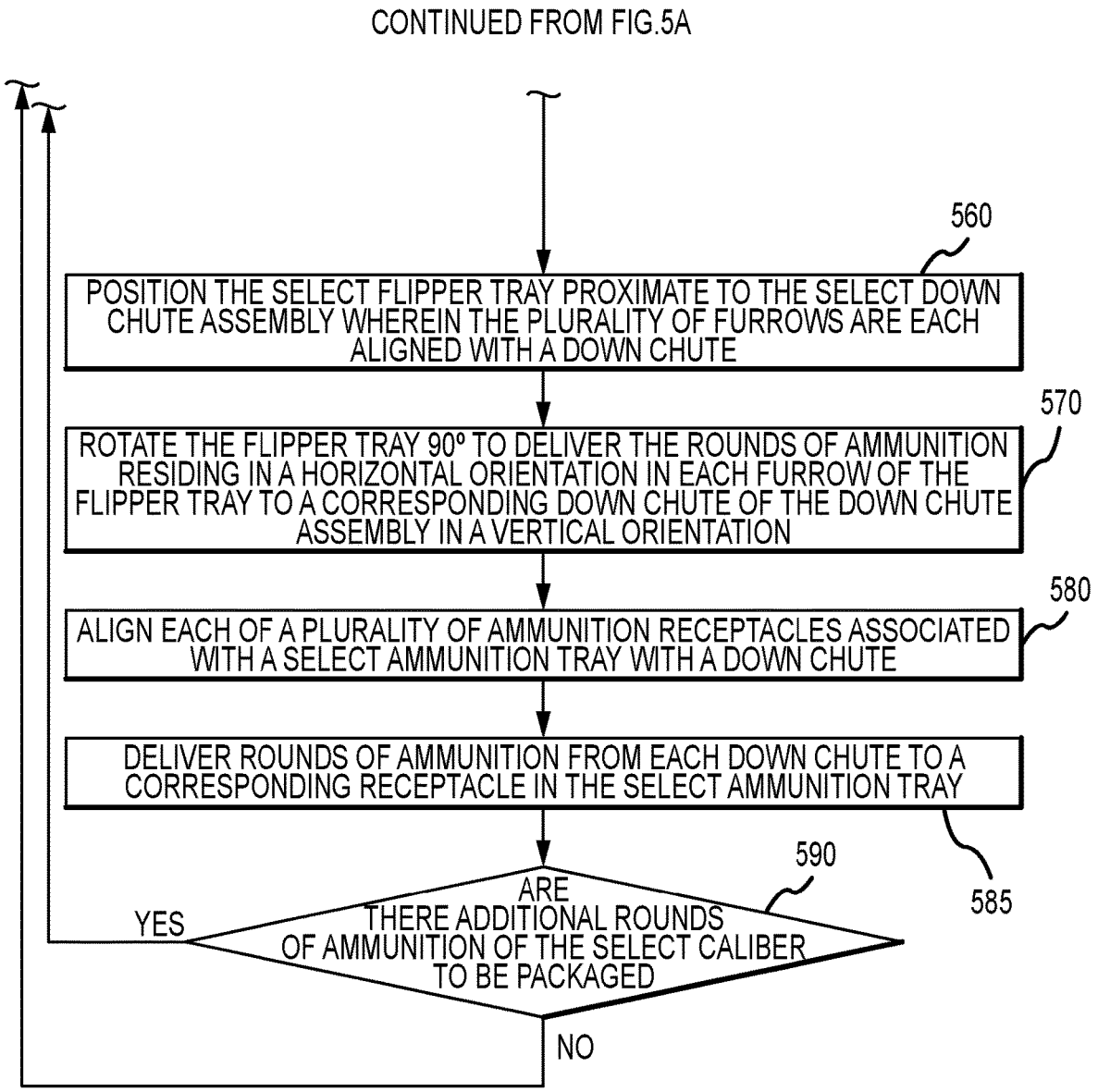

The process by which the reconfigurable ammunition packaging apparatus operates is illustrated by the system diagram shown in FIG. 4 in combination with the flowchart of FIG. 5. Once a specific caliber of ammunition has been selected 505 for collation and packaging, the set of components 310, 320, 330 (collator plate 115, ammunition channel 130, flipper tray 140, down chute assembly 160 and ammunition trays 180) are installed 510 on the apparatus 120. The controller is informed via input from a user interface 380 that a specific caliber of ammunition is being packaged. Upon receiving such input, the controller 370 retrieves 524 instructions for the storage media 375 and executes them in preparation to drive the various motors in a manner specific to that caliber.

Loose rounds of ammunition of the selected caliber are placed 520 in the ammunition collator 110. Upon initiating operations, the collator 110 rotates causing rounds to fall within the grooves of the collator plate 115. The groove are caliber and shape specific and design such that each round is orientate outward within the groove. That is to say that the bullet end of each cartridge is pointed toward the collator cylindrical wall with the casing proximate to the center of the collator. As the collator and collator plate rotates rounds with each groove are delivered 526 by gravity to an awaiting ammunition channel 130. One or reasonable skill in the relevant art will appreciate that types of collators exist. For the purpose of the present invention the collator delivers rounds of ammunition in a specific orientation to the ammunition channel.

The ammunition channel 130 is posited directly below a discharge port on the underside of the collator 110. As the collator 110 and collator plate 115 rotates, the groove aligns with a void in the bottom face of the collator allowing the round to fall into the first opening of the ammunition channel. The ammunition channel 130, or zig zag channel as it is sometimes referred, stacks the rounds vertically in a horizontal orientation. A sensor within the ammunition channel 130 communicates with the controller 370 whether 530 there are sufficient rounds within the channel to fill the furrows of the flipper tray. When 540 the ammunition channel 130 has a maximum allowable number of rounds, the controller 370 stops 535 the collators ceasing deliver of rounds to the ammunition channel 130. Similarly, when the number of rounds within the ammunition channel 130 drop below a certain level, a message is sent to the controller 370 which in turn reactivates the collator 110.

With sufficient rounds within the ammunition channel 130, the controller 370 directs 550 a motor to drive the flipper tray 140 beneath the ammunition channel 130. As furrows within the flipper tray 130 are presented below the second opening of the ammunition channel 130, a round of ammunition drops into each furrow. Upon determining 555 that each furrow of the flipper tray is occupied by a round of ammunition, the motor drives 560 the flipper tray 130 to end of a track, proximate to the down chute assembly 160. As each furrow is aligned with a down chute, the controller directs the flipper tray 140 to rotate 570 90 degrees delivering the rounds residing in the furrows to the down chutes, now in a vertical orientation.

The bidirectional capability afforded by the innovation of the flipper tray 140, whose design and function allow it to deliver rounds to a down-chute assembly 160 on each "pass"—left-to-right or right-to-left—enable very rapid loading rates.

As the rounds descend through the down chute they are arrive into receptacles of an ammunition tray 180 positioned 580 directly below each chute exit. Upon delivery 585 of the rounds into the receptacles of the ammunition tray 180 the controller 370 directs 590 the ammunition tray 180 to advance positioning the next row of receptacles under the down chutes awaiting another set of rounds.

As described above, the flowchart of FIG. 5 depicts an example methodology which may be used to package ammunition using the reconfigurable ammunition packaging apparatus of the present invention. In the description, it will be understood that each block of the flowchart illustrations, and combinations of blocks in the flowchart illustrations, can be implemented by computer program instructions. These computer program instructions may be loaded onto a computer or other programmable apparatus to produce a machine such that the instructions that execute on the computer or other programmable apparatus create means for implementing the functions specified in the flowchart block or blocks. These computer program instructions may also be stored in a computer-readable memory that can direct a computer or other programmable apparatus to function in a particular manner such that the instructions stored in the computer-readable memory produce an article of manufacture including instruction means that implement the function specified in the flowchart block or blocks. The computer program instructions may also be loaded onto a computer or other programmable apparatus to cause a series of operational steps to be performed in the computer or on the other programmable apparatus to produce a computer implemented process such that the instructions that execute on the computer or other programmable apparatus provide steps for implementing the functions specified in the flowchart block or blocks.

Accordingly, blocks of the flowchart illustrations support combinations of means for performing the specified functions and combinations of steps for performing the specified functions. It will also be understood that each block of the flowchart illustrations, and combinations of blocks in the flowchart illustrations, can be implemented by special purpose hardware-based computer systems that perform the specified functions or steps, or combinations of special purpose hardware and computer instructions.

Some portions of this specification are presented in terms of algorithms or symbolic representations of operations on data stored as bits or binary digital signals within a machine memory (e.g., a computer memory). These algorithms or symbolic representations are examples of techniques used by those of ordinary skill in the data processing arts to convey the substance of their work to others skilled in the art. As used herein, an "algorithm" is a self-consistent sequence of operations or similar processing leading to a desired result. In this context, algorithms and operations involve the manipulation of information elements. Typically, but not necessarily, such elements may take the form of electrical, magnetic, or optical signals capable of being stored, accessed, transferred, combined, compared, or otherwise manipulated by a machine. It is convenient at times, principally for reasons of common usage, to refer to such signals using words such as "data," "content," "bits," "values," "elements," "symbols," "characters," "terms," "numbers," "numerals," "words", or the like. These specific words, however, are merely convenient labels and are to be associated with appropriate information elements.

Unless specifically stated otherwise, discussions herein using words such as "processing," "computing," "calculating," "determining," "presenting," "displaying," or the like may refer to actions or processes of a machine (e.g., a computer) that manipulates or transforms data represented as physical (e.g., electronic, magnetic, or optical) quantities within one or more memories (e.g., volatile memory, non-volatile memory, or a combination thereof), registers, or other machine components that receive, store, transmit, or display information.

In a preferred embodiment, a portion of the present invention can be implemented in software. Software programming code which embodies the present invention is typically accessed by a microprocessor from long-term, persistent storage media of some type, such as a flash drive or hard drive. The software programming code may be embodied on any of a variety of known media for use with a data processing system, such as a diskette, hard drive, CD-ROM, or the like. The code may be distributed on such media or may be distributed from the memory or storage of one computer system over a network of some type to other computer systems for use by such other systems. Alternatively, the programming code may be embodied in the memory of the device and accessed by a microprocessor using an internal bus. The techniques and methods for embodying software programming code in memory, on physical media, and/or distributing software code via networks are well known and will not be further discussed herein.

Generally, program modules include routines, programs, objects, components, data structures and the like that perform particular tasks or implement particular abstract data types. Moreover, those skilled in the art will appreciate that the invention can be practiced with other computer system configurations, including hand-held devices, multi-processor systems, microprocessor-based or programmable consumer electronics, network PCs, minicomputers, mainframe computers, and the like. The invention may also be practiced in distributed computing environments where tasks are performed by remote processing devices that are linked through a communications network. In a distributed computing environment, program modules may be located in both local and remote memory storage devices.

An exemplary system for implementing the invention includes a general purpose computing device such as the form of a conventional personal computer, a personal communication device or the like, including a processing unit, a system memory, and a system bus that couples various system components, including the system memory to the processing unit. The system bus may be any of several types of bus structures including a memory bus or memory controller, a peripheral bus, and a local bus using any of a variety of bus architectures. The system memory generally includes read-only memory (ROM) and random-access memory (RAM). A basic input/output system (BIOS), containing the basic routines that help to transfer information between elements within the personal computer, such as during start-up, is stored in ROM. The personal computer may further include a hard disk drive for reading from and writing to a hard disk, a magnetic disk drive for reading from or writing to a removable magnetic disk. The hard disk drive and magnetic disk drive are connected to the system bus by a hard disk drive interface and a magnetic disk drive interface, respectively. The drives and their associated computer-readable media provide non-volatile storage of computer readable instructions, data structures, program modules and other data for the personal computer. Although the exemplary environment described herein employs a hard disk and a removable magnetic disk, it should be appreciated by those skilled in the art that other types of computer readable media which can store data that is accessible by a computer may also be used in the exemplary operating environment.

While there have been described above the principles of the present invention in conjunction with a reconfigurable ammunition packaging apparatus, it is to be clearly understood that the foregoing description is made only by way of example and not as a limitation to the scope of the invention. Particularly, it is recognized that the teachings of the foregoing disclosure will suggest other modifications to those persons skilled in the relevant art. Such modifications may involve other features that are already known per se and which may be used instead of or in addition to features already described herein. Although claims have been formulated in this application to particular combinations of features, it should be understood that the scope of the disclosure herein also includes any novel feature or any novel combination of features disclosed either explicitly or implicitly or any generalization or modification thereof which would be apparent to persons skilled in the relevant art, whether or not such relates to the same invention as presently claimed in any claim and whether or not it mitigates any or all of the same technical problems as confronted by the present invention. The Applicant hereby reserves the right to formulate new claims to such features and/or combinations of such features during the prosecution of the present application or of any further application derived therefrom.

What is claimed is:

1. A method for convertible ammunition packaging, comprising:

configuring an ammunition collator with a collator plate based on a first ammunition caliber, wherein the ammunition collator consistently orientates one or more rounds of ammunition;

coupling an ammunition channel to the ammunition collator, wherein the ammunition channel is sized for the first ammunition caliber wherein the one or more rounds of ammunition are delivered sequentially from the ammunition collator to a first opening of the ammunition channel in a horizontal orientation, and wherein each round of ammunition is alternatively laterally displaced along a vertical zig-zag path;

positioning a flipper tray beneath a second opening of the ammunition channel, wherein the flipper tray includes a plurality of furrows configured for the first ammunition caliber and wherein the positioning includes moving the flipper tray laterally to accept a single round of ammunition in each furrow in the horizontal orientation;

positioning a down chute assembly proximate to the flipper tray, wherein the down chute assembly includes a plurality of down chutes of the first ammunition caliber in a vertical orientation, the plurality of down chutes matching the plurality of furrows, each down chute configured to accept the single round of ammunition residing in a corresponding one of the plurality of furrows;

rotating the flipper tray 90 degrees from the horizontal orientation to the vertical orientation responsive to the plurality of furrows being aligned with the plurality of down chutes, thereby placing each single round of ammunition residing in the corresponding furrow in the aligned down chute of the down chute assembly in the vertical orientation; and aligning each of a plurality of ammunition receptacles of an ammunition tray configured for the first ammunition caliber with a corresponding one of the down chutes of the down chute assembly so as to moveably accept the single round of ammunition residing in the corresponding down chute in the vertical orientation.

2. The method for convertible ammunition packaging according to claim 1, wherein the ammunition channel, the flipper tray, the down chute assembly, and the ammunition tray associated with the first ammunition caliber are each removably reconfigurable for a second ammunition caliber.

3. The method for convertible ammunition packaging according to claim 1, wherein the collator plate, the ammunition channel, the flipper tray, the down chute assembly, and the ammunition tray define a first component set associated with the first ammunition caliber and wherein a second collator plate, a second ammunition channel, a second flipper tray, a second down chute assembly, and a second ammunition tray define a second component set associated with a second ammunition caliber.

4. The method for convertible ammunition packaging according to claim 3, further comprising reconfiguring to the second ammunition caliber from the first ammunition caliber by replacing the first component set with the second component set.

5. The method for convertible ammunition packaging according to claim 1, further comprising executing, by a machine, instructions embodied as software, wherein one of said invention is configured to movably position each furrow of the flipper tray beneath the ammunition channel based on an ammunition caliber.

6. The method for convertible ammunition packaging according to claim 1, further comprising executing, by a machine, instructions embodied as software, wherein one of said invention is configured to movably position the ammunition tray to align each down chute with a corresponding one of the plurality of ammunition receptacles based on an ammunition caliber.

* * * * *